United States Patent [19]

Freitag

[11] Patent Number: 4,509,816

[45] Date of Patent: Apr. 9, 1985

[54] PLUG CONNECTOR FOR CO-AXIAL ELECTRICAL CABLES

[76] Inventor: Wolfgang Freitag, Arndtstrasse 9-11, 2351 Trappenkamp, Fed. Rep. of Germany

[21] Appl. No.: 528,001

[22] Filed: Aug. 31, 1983

[51] Int. Cl.[3] ..... H01R 17/18

[52] U.S. Cl. ..... 339/177 R; 339/276 R

[58] Field of Search ..... 339/177, 276

[56] References Cited

U.S. PATENT DOCUMENTS

| | | | |
|---|---|---|---|
| 3,323,098 | 5/1967 | O'Keefe et al. | 339/177 R |
| 3,331,917 | 7/1967 | O'Keefe et al. | 339/276 R |
| 3,539,976 | 11/1970 | Reynolds | 339/177 E |
| 3,781,763 | 12/1973 | Feeser et al. | 339/177 E |
| 3,845,453 | 10/1974 | Hemmer | 339/177 R |
| 4,249,790 | 2/1981 | Ito et al. | 339/177 E |
| 4,307,926 | 12/1981 | Smith | 339/177 R |

OTHER PUBLICATIONS

IBM Technical Disclosure Bulletin, H. C. Schick "Crushed Tubing Coaxial Connector", vol. 7, No. 1, (6/1964), pp. 91, 92.

*Primary Examiner*—Gil Weidenfeld
*Assistant Examiner*—David L. Pirlot
*Attorney, Agent, or Firm*—Sughrue, Mion, Zinn, Macpeak and Seas

[57] ABSTRACT

The connector according to the invention comprises a dielectric carrying the sleeve-like outer connector conductor as well as the central inner connector conductor. The connection of the connector conductors to the cable conductors is performed by crimping. In order that this connector may be simplified structurally and assembled more rapidly, the connector dielectric has a portion which projects at least partially into the axial area of the cable connection portion of the outer connector conductor, in such manner that the radial force of the portion exerted in inward direction as a result of the crimping of the cable connection portion complementarily acts over the axial area at least on the cable-side radially yielding reception portion of the inner connector conductor.

5 Claims, 4 Drawing Figures

PLUG CONNECTOR FOR CO-AXIAL ELECTRICAL CABLES

BACKGROUND OF THE INVENTION

The present invention relates to a plug connector for co-axial electrical cables, wherein the connector dielectric carrying the sleeve-like outer conductor of the connector as well as the central inner connector conductor has a portion which upon connecting the inner cable conductor electrically to the receiving portion of the inner connector conductor is pressed against the receiving portion wherein the outer connector conductor has a cable connection portion for the outer cable conductor which is to be connected thereto, and wherein the electrical connection of the cable conductors to the connector conductors is established by crimping.

German Offenlegungschrift No. 1 615 551 describes a co-axial electrical plug connector which is connected to the cable by crimping operations, the inner and outer conductors of the connector being connected electrically to those of the co-axial cable by two separate crimping operations. A separate crimping sleeve is provided for this purpose which, after the cable screening is placed on the connecting portion of the outer connector conductor, is pushed over this portion and then crimped to connect the cable screening electrically. Furthermore, the pin-like inner connector conductor is crimped on separately by being squeezed on to the insulated inner cable conductor in remanently upset form. Since this occurs when the plug connector has been threaded as a whole on to the prepared cable end, the outer connector conductor complementarily has two radial holes through which the crimping tool for the inner conductors has to be passed. The outer connector conductor comprises these complementary holes in its plug-in side area, said holes being arranged offset axially in forward direction with respect to the crimping point of the outer conductors, so that the crimping of the inner conductors may be performed after the crimping of the outer conductors, or vice versa.

It is an object of the invention to provide a plug connector which is to be joined to a co-axial electrical cable by crimping, which may be connected completely electrically to the co-axial cable by a single crimping operation.

SUMMARY OF THE INVENTION

To fulfil this and other objects, in a plug connector as hereinabove set forth the said portion of the connector dielectric projects at least partially into the axial area of the cable connection portion of the outer connector conductor, in such manner that the radial force of the portion exerted inwardly by the crimping of the cable connection portion complementarily acts via the said portion on at least the cable-side radially yielding receiving portion of the inner connector conductor.

A plug connector of this improved kind may be installed rapidly and wholly functionally on a co-axial cable, since the inner conductors as well as the outer conductors of the connector and cable are reliably interconnected electrically merely by deformation by crimping of the cable connection portion of the outer connector conductor. The crimping of the inner connector conductor on to the inner cable conductor, which is otherwise required separately, is thus eliminated since the crimping of the outer connector sleeve over the connector dielectric simultaneously exerts a corresponding clamping force on the inner conductors which are to be joined to each other. Furthermore, the connecting method proposed also yields a simplified form of construction of the plug connector, since the said holes in the outer connector conductor are omitted.

In an advantageous development of the invention, the said portion of the connector dielectric is constructed in lengthened form at the cable side and is provided thereat with an internal pattern acting in form-locking manner, which by virtue of the said radial force may be placed in engagement with the cable dielectric. An improved mechanical fastening of the connector to the co-axial cable, acting in traction-relieving manner, is simultaneously also obtained thereby, since the connector dielectric extended at the cable side engages in form-locked manner and thus comparatively deeply in the cable dielectric and may anchor itself securely therein.

BRIEF DESCRIPTION OF THE DRAWINGS

In order that the invention may be more clearly understood reference will now be made to the accompanying drawings which show some embodiments thereof by way of example and in which.

DETAILED DESCRIPTION OF THE PREFERRED EMBODIMENTS

Figure 1:
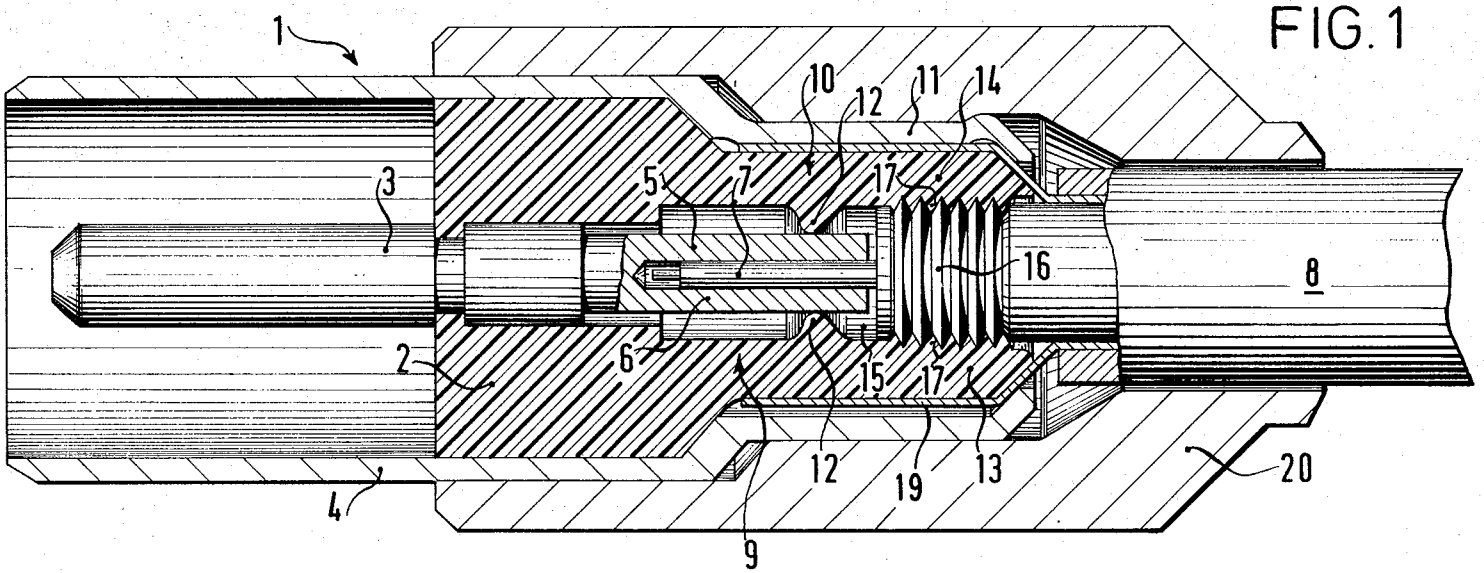
FIG. 1 shows an axial section through a first embodiment.
Figure 3:
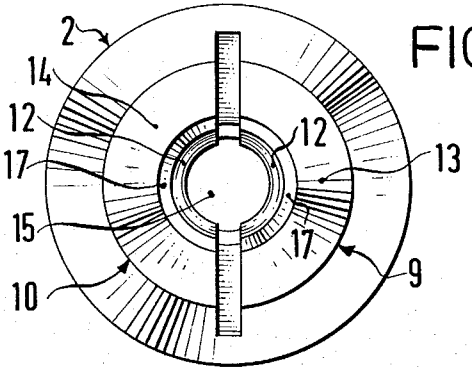
FIG. 3 shows an end view according to the arrow III in FIG. 2.

Referring now to the drawings, in the case of the plug connector for co-axial electrical cables which is generally marked 1 in FIG. 1, a connector dielectric 2 carries a central inner conductor 3 and a sleeve-like external conductor 4. The inner conductor 3 is divided at the cable side into two spring branches 5,6 forming a receiving portion, said branches coming into contact in conventional manner against the inner conductor 7 of a co-axial cable 8 connectible to the connector 1. The connector dielectric has two clamping projections 9,10 extending rearwards axially and opposed to each other. The material of the dielectric 2 may be a soft plastics material or a harder but pliable plastics material, so that the projections may be radially compressible or deflectible. The outer conductor 4 of the connector 1 has a sleeve-like cable connection portion 11 extending in a rearward direction and of smaller diameter, which surrounds the projections 9,10. This portion 11 is exposed to a crimping deformation, as will become apparent.

The projections 9,10 of the dielectric 2 may be provided internally with an encircling roll 12 in each case, each roll merely lying in touching contact against a spring branch 5 or 6 of the inner connector conductor 3 when the co-axial cable 8 is not connected.

Figure 2:
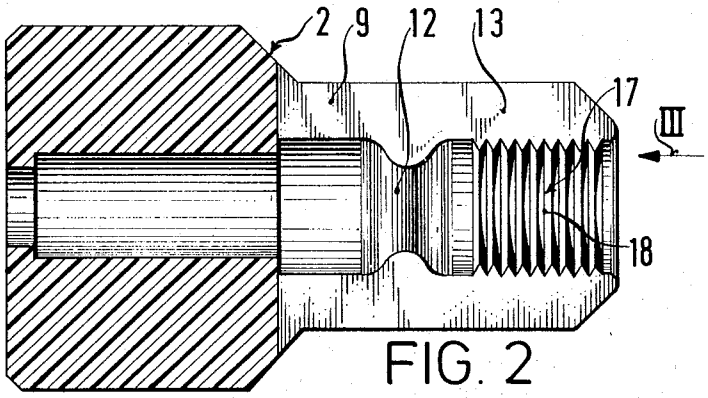
FIG. 2 shows an axial section through the connector dielectric according to FIG. 1.

The two projections may be lengthened axially in the direction of the cable-side connector extremity beyond the area of the roll 12. The extensions 13,14 thus available between them form a space for reception of the dielectric 16 of the co-axial cable 8 and are provided internally with a pattern 17 acting in form-locking manner. This pattern may be constructed as serrations 18 as apparent particularly clearly from FIG. 2, but may also have another form appropriate to penetrate into the dielectric 16 in form-locking and anchoring manner.

To fit the connector 1 to the co-axial cable 8, the prepared cable end is inserted into the connector, in such manner that the inner cable conductor 7 is positioned between the spring branches 5,6 and the braid-like cable screening 19 acting as the outer cable conductor is positioned between the connector dielectric and the portion 11 of the outer connector conductor 4. The portion 11 is then pressed inwards radially by means of a crimping tool (not shown), thereby permanently deforming the same in corrugated or analogous form, an inwardly directed radial force acting as a clamping force springing from these deformations. A protective cap 20 is then pushed over the outer connector conductor 4, which engages in the said groove-like depressions of the portion 11.

The projections 9,10 extend at least partially into the inner axial area of the cable connection portion 11 of the outer sleeve 4, so that the outer conductors 4,19 as well as the inner conductors 3,7 are interconnected reliably electrically at the same time by deformation by crimping of the portion 11.

The projections 13,14 which engage with their pattern 17 in the cable dielectric 16 are provided in the advantageous development according to FIG. 1. Apart from clamping the said inner conductors, the deformation by crimping of the portion 11 formed to appropriate length also causes a simultaneous fastening of the projections 9,10 to the cable dielectric 16.

Figure 4:
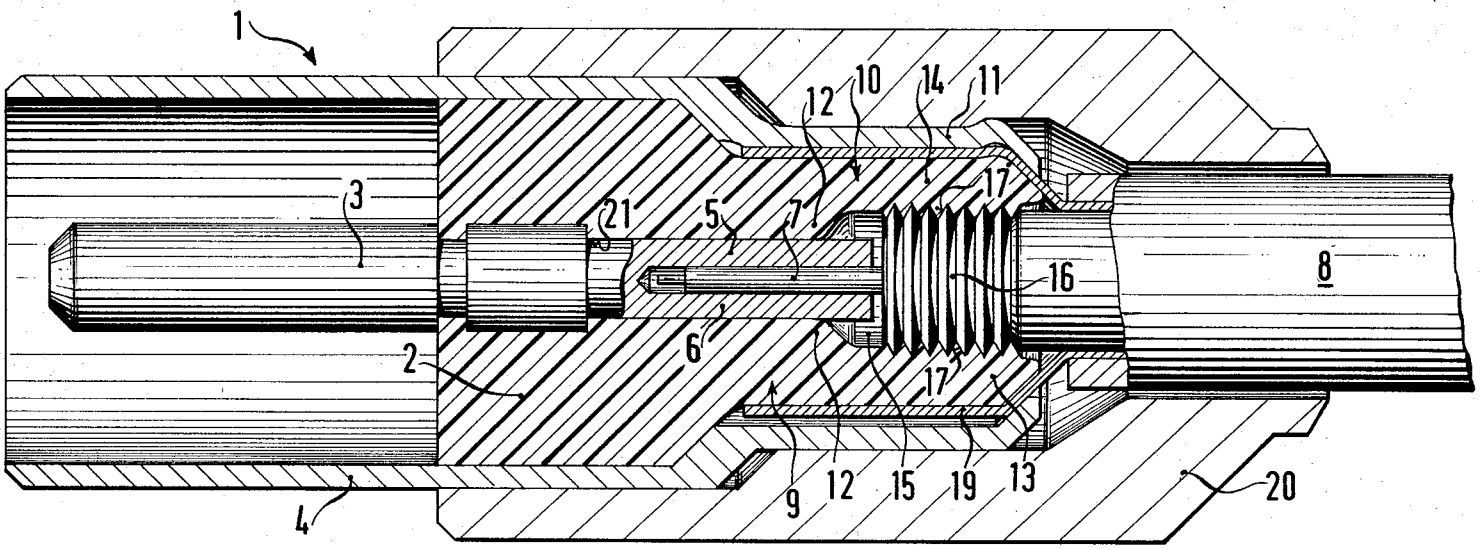
FIG. 4 shows an axial section through another embodiment.

The embodiment according to FIG. 1 discloses an annular roll 12 on the connector dielectric 2. This roll need not necessarily be incorporated, as apparent from FIG. 4. A central axial passage 21 may as an alternative be provided in the dielectric 2 according to FIG. 4, which is matched to the spring branches 5,6 as apparent. In this case too, the radial pressure on the projections 9,10 causes the spring branches 5,6 to be thrust against the inner cable conductor 7.

In further embodiment of the connector 1 described in the foregoing, its sleeve-like outer conductor 4 may be constructed in several parts, which is not shown since it is known per se. The plug-in side portion of the connector may thus comprise a turned component, and the cable-side portion encompassing the portion 11 may comprise a sheet metal element which is bent into the required round form after being stamped out. This sheet metal element may then be crimped in simple manner.

I claim:

1. In a plug connector for co-axial electrical cables, in which a connector dielectric carrying a sleeve-like external conductor of the connector as well as a central internal conductor of the connector has a portion which, upon connecting the internal cable conductor electrically to a receiving section of the internal conductor of the connector, is pressed against the receiving section, wherein the external connector conductor has a cable connection portion for the outer cable conductor intended to be connected thereto, and wherein the electrical connection of the cable conductors to the connector conductors is established by crimping, the improvement which consists in that said portion of the connector dielectric projects at least partially into an axial area of the cable connection portion of the external connector conductor, in such manner that an inwardly exerted radial force on said connector dielectric portion applied by crimping of the cable connection portion complementarily acts via the connector dielectric portion on at least the radially yielding receiving portion of the inner connector conductor.

2. A plug connector according to claim 1, wherein said portion of the connector dielectric has an internal annular roll which acts on the radially yielding receiving portion of the inner connector conductor.

3. A plug connector according to claim 1, wherein the outer connector conductor is produced as a multi-sectional sleeve the cable connection portion of which is arranged to be crimped.

4. A plug connector according to claim 1, wherein the said portion of the connector dielectric is produced in lengthened form at its cable insertion side and is provided with a shaped portion acting in form-locking manner, which by virtue of the said radial force may be placed in engagement with the cable dielectric.

5. A plug connector according to claim 4, wherein said shaped portion acting in form-locking manner consists of serrations.

* * * * *